US008376183B1

(12) United States Patent
Rosen

(10) Patent No.: US 8,376,183 B1
(45) Date of Patent: Feb. 19, 2013

(54) FLUID DISPENSER HAVING MULTIPLE CHAMBERS

(75) Inventor: Ian K. Rosen, North Muskegon, MI (US)

(73) Assignee: AGS I-Prop, LLC, Muskegon, MI (US)

( * ) Notice: Subject to any disclaimer, the term of this patent is extended or adjusted under 35 U.S.C. 154(b) by 413 days.

(21) Appl. No.: 12/468,521

(22) Filed: May 19, 2009

Related U.S. Application Data

(60) Provisional application No. 61/060,312, filed on Jun. 10, 2008.

(51) Int. Cl.
*B67B 7/00* (2006.01)
*B65D 35/22* (2006.01)
*B65D 35/00* (2006.01)

(52) U.S. Cl. ..... 222/1; 222/94; 222/106; 222/145.1; 222/482

(58) Field of Classification Search ..... 222/94, 222/106, 145.1, 482, 1; 221/133; 206/219, 206/531, 538, 484; 426/115, 394
See application file for complete search history.

(56) References Cited

U.S. PATENT DOCUMENTS

| | | | | |
|---|---|---|---|---|
| 301,977 | A | 7/1884 | French | |
| 571,521 | A | 11/1896 | Heberline et al. | |
| 1,994,764 | A | 3/1935 | Greedy | |
| 2,637,872 | A | 5/1953 | Holbrook | |
| RE24,251 | E | 12/1956 | Kaplan et al. | |
| 2,896,381 | A | 7/1959 | Lange | |
| 3,009,498 | A | 11/1961 | Fohr | |
| 3,128,920 | A | 4/1964 | Volckening et al. | |
| 3,163,971 | A | 1/1965 | Loliger et al. | |
| 3,179,286 | A | 4/1965 | Morceau | |
| 3,184,121 | A | 5/1965 | Volckening | |
| 3,189,227 | A | 6/1965 | Hobbs et al. | |
| 3,224,640 | A | 12/1965 | Schneider et al. | |
| 3,524,537 | A | 8/1970 | Winter | |
| 3,736,933 | A * | 6/1973 | Szabo | 604/200 |
| 3,741,778 | A | 6/1973 | Rowe | |
| 3,783,581 | A | 1/1974 | Pierce | |
| 3,789,569 | A | 2/1974 | Egger | |
| 3,815,794 | A | 6/1974 | Carlisle | |

(Continued)

FOREIGN PATENT DOCUMENTS

JP 57023666 A 2/1982

OTHER PUBLICATIONS

Exhibits A-D include photos of various packets believed to be on sale more than one year prior to the filing date of this application.

(Continued)

*Primary Examiner* — Kevin P Shaver
*Assistant Examiner* — Nicholas Weiss
(74) *Attorney, Agent, or Firm* — Gardner, Linn, Burkhart & Flory, LLP

(57) ABSTRACT

A fluid dispenser for containing multiple portions of flowable material in multiple chambers separated by dividers includes a dispensing passageway at one of the chambers, with each divider having an openable region to permit flow of fluid from an adjacent chamber into the chamber having the dispensing passageway so that only a selected portion of flowable material may be expunged from the container at a time, without all of the contents reaching the dispensing passageway until such time as it is desired. The user may select the quantity of material to be dispensed and may squeeze the chamber or chambers to break or open the desired or appropriate number of dividers to dispense the desired or appropriate quantity of flowable material through the dispensing passageway of the container. Optionally, each chamber may have a respective dispensing passageway that is openable to dispense the contents of the respective chamber.

10 Claims, 3 Drawing Sheets

U.S. PATENT DOCUMENTS 3,862,684 A 1/1975 Schmitt
3,865,157 A 2/1975 Knabe et al.
3,878,977 A 4/1975 Carlisle
3,911,642 A 10/1975 Ernstsson et al.
3,913,734 A 10/1975 Siegel
3,922,835 A 12/1975 Reil
3,971,149 A 7/1976 Tanney
4,045,939 A 9/1977 Baumstingl
4,163,509 A * 8/1979 Amneus ..... 222/95
D253,040 S 10/1979 Fournier et al.
4,199,915 A 4/1980 Levine
4,252,257 A 2/1981 Herzig
4,328,912 A 5/1982 Haggar et al.
4,402,402 A * 9/1983 Pike ..... 206/219
4,417,607 A 11/1983 Scholle et al.
4,491,245 A 1/1985 Jamison
4,548,606 A 10/1985 Larkin
4,566,249 A 1/1986 Schwerdtel et al.
4,671,452 A 6/1987 Pupp et al.
4,683,701 A 8/1987 Rangwala et al.
4,707,334 A 11/1987 Gerhard
4,769,974 A 9/1988 Davis
4,921,137 A 5/1990 Heijenga
4,988,016 A 1/1991 Hawkins et al.
5,018,646 A 5/1991 Billman et al.
5,020,303 A 6/1991 Vokins
5,024,536 A 6/1991 Hill
5,029,430 A 7/1991 Davis
5,072,855 A 12/1991 Herzig
5,111,932 A 5/1992 Campbell
5,368,828 A 11/1994 Carlson
5,377,475 A 1/1995 Haarer et al.
5,398,734 A 3/1995 Hartel
D368,428 S 4/1996 Croft
5,529,224 A 6/1996 Chan et al.
5,660,100 A 8/1997 Spelten et al.
5,839,609 A 11/1998 Zakensberg
5,897,833 A 4/1999 Hunt et al.
5,971,225 A 10/1999 Kapsa
5,996,845 A 12/1999 Chan
6,007,264 A * 12/1999 Koptis ..... 401/132
6,094,887 A 8/2000 Swank et al.
6,096,265 A 8/2000 Mezger et al.
6,120,730 A 9/2000 Palaniappan et al.
6,129,959 A 10/2000 Mercer et al.
6,199,719 B1 3/2001 Bordage
6,247,617 B1 6/2001 Clyde et al.
6,431,227 B1 8/2002 Ter Haar
6,557,731 B1 5/2003 Lyon et al.
6,622,457 B2 9/2003 Kurth
6,626,296 B1 9/2003 Jimu et al.
6,629,401 B1 10/2003 Hins et al.
6,666,002 B1 12/2003 Otsuka et al.
6,691,747 B1 2/2004 Marcus et al.
6,718,735 B2 4/2004 Lewis, Jr. et al.
6,752,959 B2 6/2004 Smith et al.
6,786,249 B2 9/2004 Ambruster et al.
6,786,515 B2 9/2004 Franko, Sr.
6,905,075 B1 6/2005 Rosen et al.
6,945,013 B2 9/2005 Taggart
7,014,041 B1 3/2006 Rosen et al.
7,097,075 B2 * 8/2006 Peuker et al. ..... 222/94
7,241,066 B1 7/2007 Rosen et al.
7,458,741 B2 * 12/2008 Detwiler et al. ..... 401/132
2001/0030133 A1 10/2001 Shibata
2002/0083682 A1 7/2002 Edwards et al.
2003/0140532 A1 7/2003 Deuerling
2007/0119862 A1 * 5/2007 Backes et al. ..... 222/94
2007/0253761 A1 * 11/2007 May ..... 401/133
2008/0083348 A1 * 4/2008 Kuo et al. ..... 106/35

OTHER PUBLICATIONS

U.S. Appl. No. 12/172,441, filed Jul. 14, 2008.

* cited by examiner

FLUID DISPENSER HAVING MULTIPLE CHAMBERS

CROSS REFERENCE TO RELATED APPLICATION

The present application claims the benefit of U.S. provisional application Ser. No. 61/060,312, filed Jun. 10, 2008, which is hereby incorporated herein by reference in its entirety.

FIELD OF THE INVENTION

The present invention relates generally to containers and fluid dispensers.

BACKGROUND OF THE INVENTION

Various containers are known for dispensing fluids, liquids, and other flowable substances. A common type of fluid dispenser is a squeezable packet, which may be used to dispense lubricants, lotion, or other fluid substances. Squeezable packets are typically intended for single use, whereby using less than the full quantity of fluid from the packet typically results in subsequent leakage of the remaining fluid and/or drying of the remaining fluid such that it cannot be used again later. Further, it can be difficult to accurately measure a portion of the total fluid in the packet if less than the full quantity is desired.

SUMMARY OF THE INVENTION

The present invention provides a fluid dispenser, such as a squeezable packet or flexible pouch, having two or more closed chambers for containing two or more bodies or quantities of the same flowable material, such as grease, lubricant, lotion, insect repellent, cleaning fluid, or the like. The fluid dispenser includes a divider between each of the chambers, the divider at least temporarily preventing flow of flowable material between the chambers. A dispensing portion is provided at at least one of the chambers. The dividers are equipped with frangible regions or walls or valve portions that permit flowable material to flow through the frangible region or valve when sufficient pressure is applied to a fluid-filled chamber on one side of the divider, in order to dispense the flowable material from one or more chambers through a single dispensing portion.

According to an aspect of the present invention, a fluid container and dispenser comprises a flexible pouch or container for storing a flowable material. The container is formed from two flexible sheets or films or sheet portions that are sealed together about their opposed perimeter regions so as to form at least two closed chambers for containing the flowable material between the non-sealed portions of the opposed flexible sheets. A divider is provided between the at least two closed chambers to separate the contents of each of the chambers. A dispensing portion is provided at at least one of the chambers for dispensing the flowable material from the chamber when the dispensing portion is opened. Each of the at least two closed chambers contains a flowable material, with the flowable material or composition being substantially identical in each chamber.

In one form, the divider includes a frangible region that is breakable to permit flow of the flowable material in one chamber into an adjacent chamber, such as by applying sufficient pressure to a chamber on one side of the divider to burst the frangible region so as to allow the flowable material to flow into another chamber for dispensing therefrom. Optionally, the divider may include a valve or flow-limiting element that permits one way flow of the flowable material between two adjacent chambers.

Optionally, a portion of the container at each of the dispensing portions is at least partially removable in order to open the dispensing portion to permit the dispensing of flowable material from at least one of the chambers. Optionally, the perimeter of the container may include a header portion at an end of the container. The header portion may comprise a removable portion for opening the dispensing portion.

In another form, a non-frangible or non-openable divider is established between at least two chambers on one side of the non-openable divider and at least two chambers on an opposite side of the divider. The two chambers on either side of the non-openable divider are at least initially separated by an openable or frangible divider. The chambers on one side of the non-openable divider contain a different material composition than the chambers on the opposite side of the divider.

According to another aspect of the present invention, a method or means for dispensing a flowable material onto an object or surface includes providing a flexible pouch type container for storing the flowable material. The container includes first and second sheet portions sealed together along a perimeter of the container to define at least two chambers for containing separate portions of the same flowable material, and to define a dispensing passageway at one of the chambers. The chambers are separated by at least one divider that at least initially limits or prevents flow of the flowable material between the chambers. The sheet portions are sealed together at a dispensing portion to define a dispensing passageway. The method includes opening the dispensing passageway and applying pressure to the first chamber to dispense the flowable material from the first chamber onto the surface. Pressure is applied to the second chamber to urge the flowable material through the divider and into said first chamber. By applying pressure to the second chamber, the flowable material that was originally in the second chamber is then communicated into the first chamber and dispensed through the dispensing passageway and onto the surface.

Optionally, the container may include any number of chambers and dividers for separating the chambers. Optionally, the dividers incorporate frangible regions or valves or flow-limiting or controlling elements to permit the flowable material to pass through the dividers only when sufficient pressure is applied to a chamber.

Therefore, the fluid dispenser of the present invention includes two or more discrete chambers containing separate portions of substantially the same flowable material. Dividers between the chambers at least initially limit or substantially preclude flow of material between the chambers, and have frangible portions or valve portions that permit flowable material from one chamber to flow into the other chamber before being expelled through a dispensing portion. The present invention thus allows a user to dispense only a desired portion or quantity or amount of the flowable material from within the container or packet, while the remaining material or undispensed material may remain substantially sealed within its respective chamber or chambers. However, if a larger quantity of material is desired, the user may readily squeeze one or more of the chambers to force the material contained therein through the respective divider or dividers and out the dispensing end or region. Thus, the fluid dispenser of the present invention permits use of only a portion of the contents of the fluid dispenser, without subsequent leakage of remaining flowable material from the dispenser or container. The container also permits accurate measuring of quantities dispensed from the container, when less than all of the material contained in the container is desired for use.

These and other objects, advantages, purposes, and features of the present invention will become apparent upon review of the following specification in conjunction with the drawings.

DESCRIPTION OF THE PREFERRED EMBODIMENTS

Figure 1:
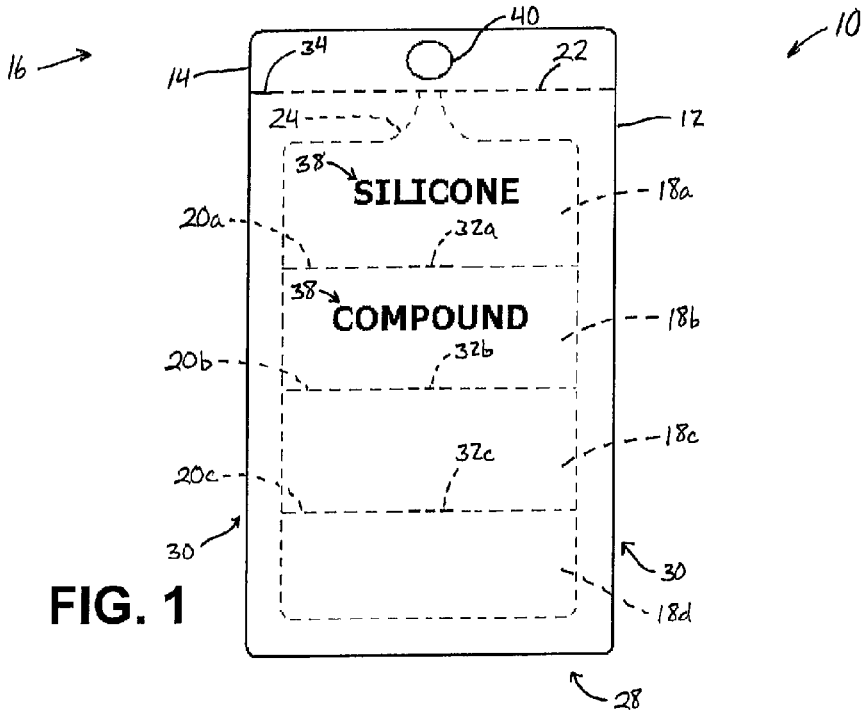
FIG. 1 is a plan view of a fluid dispenser in accordance with the present invention, with a header portion of a flexible pouch being openable and removable to open a dispensing passageway.
Figure 2:
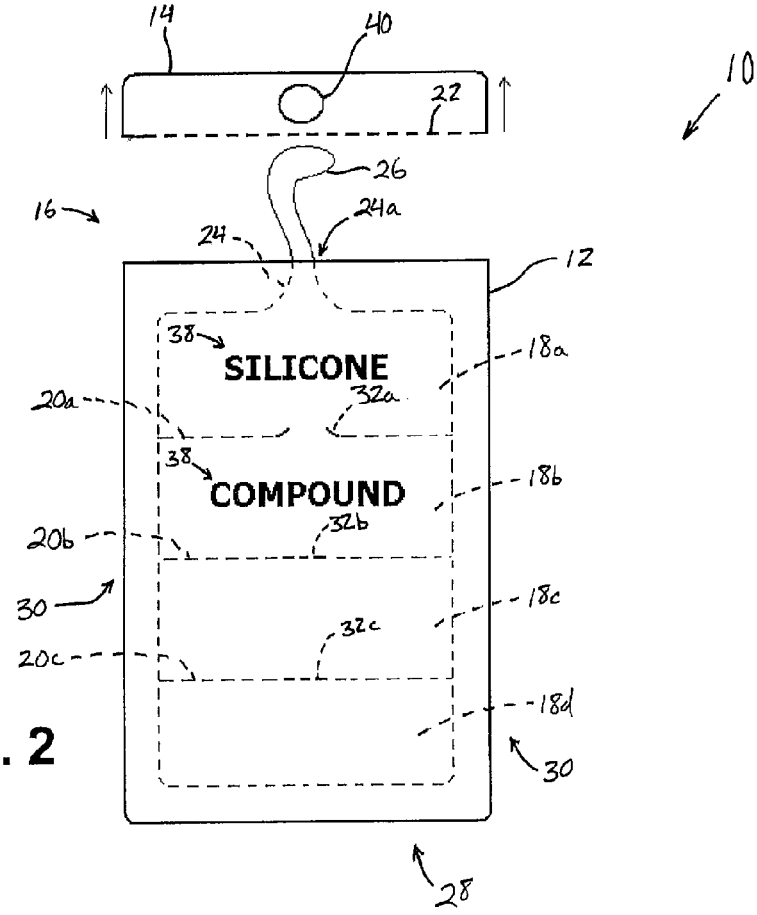
FIG. 2 is a plan view of the fluid dispenser of FIG. 1, shown with the header portion removed to open the passageway.

Referring now to the drawings and the embodiments illustrated therein, a fluid or flowable material dispenser or container 10 for dispensing fluid or flowable or viscous material comprises a flexible or squeezable pack or pouch or container 12 for holding or storing the flowable material, such as grease or lubricant or lotion or sunscreen lotion or cleaning fluid or insect repellent or the like (FIGS. 1 and 2). Flexible dispenser 10 includes a header portion 14 at a dispensing end or portion 16 of flexible pouch 12, which includes at least two cavities or chambers (such as, for example, four chambers 18*a*, 18*b*, 18*c*, 18*d* of dispenser 10), and with each chamber being separated from an adjacent chamber by a divider (such as, for example, three dividers 20*a*, 20*b*, 20*c* of dispenser 10), which remains sealed or closed until pressure is applied to one of the chambers, as discussed below. Header portion 14 is adapted to be torn or cut or otherwise removed from flexible pouch 12, such as along an opening line 22, such as a cut line or tear line or such as a perforated line or otherwise weakened line, to open a dispensing passageway 24, as also discussed below. Fluid or flowable material 26 contained within flexible pouch 12 may then flow through an opening 24*a* of dispensing passageway 24 (as shown in FIG. 2) for dispensing flowable material 26.

Flexible pouch 12 may comprise any suitable pouch or container, such as a flexible packet or tube that may be compressed or squeezed or rolled to displace and force the fluid or viscous or flowable material 26 (such as grease or other lubricant or adhesive or lotion or the like) contained therein into and through dispensing passageway 24 and opening 24*a*. The flexible pouch is formed of two flexible thin sheets or films or sheet portions that are opposed to one another and sealed or joined about their perimeter regions. The films or sheet portions may also be sealed across the packet to form or establish dividers 20*a*, 20*b*, 20*c* between the chambers 18*a*, 18*b*, 18*c*, 18*d*, with the chambers located between the unsealed portions of the opposed sheets or sheet portions. The perimeter regions of the container or pouch include a base region 28, opposite side regions 30, and header portion or region 14. When header portion 14 is removed or partially removed from container 12, dispensing passageway 24 is opened to allow flowable material 26 to be dispensed from at least chamber 18*a* (FIG. 2) and, optionally, from chambers 18*b*, 18*c*, 18*d*, as discussed below. Each chamber may be identically sized, or the chambers may vary in size, and may be marked or labeled to indicate the volume of the fluid contained in each chamber. A user may thus select a precisely known quantity of fluid to dispense from the container according to the number of chambers used and their respective volumes.

The flexible sheets or sheet portions of the pouch may comprise separate sheets or films or panels overlaid and sealed together around their perimeter regions, or may comprise a single sheet or film folded over on itself and sealed together about its perimeter regions, while remaining within the spirit and scope of the present invention. The sheets or sheet or sheet portions of flexible pouch 12 may comprise any suitable material, such as metallic foil, a polymeric material, or any other suitable flexible material that may be suitable for containing a flowable material, such as, for example, grease, lubricant, cleaning fluid, adhesive, lotion, or the like. The flowable material in each of the chambers may comprise the same or substantially same material composition, whereby the frangible dividers function to control or limit the amount of flowable material that is dispensed in a particular use of the container.

Header portion 14 may be removable from container 12 to open dispensing passageway 24 by cutting or tearing along the opening line 22. Opening line 22 may comprise a cut line or a perforated line or perforation or printed line (such as a dashed graphical depiction printed or screened along the surface of one of the sheets of the pouch) to guide or assist a user in tearing or cutting the header portion from the container. For example, opening line 22 may comprise a series of holes or perforations puncturing the surface of flexible pouch 12 (but not through the sheet portions at the dispensing passageway 24 so as to avoid leakage of the fluid through the perforations), and along which header portion 14 may be more readily torn from flexible pouch 12. Opening line 22 may ensure that header portion 14 is torn or otherwise removed from flexible pouch 12 along a predetermined line or path that intersects dispensing passageway 24, to ensure that the passageway will be opened after the removal of header portion 14. Optionally, fluid dispenser 10 may include at least one slot or notch 34 at an edge of fluid dispenser 10 and generally at opening line 22, to facilitate the beginning of the tearing of header portion 14 from flexible pouch 12, and to ensure that header portion 14 is torn along opening line 22. In the illustrated embodiment, opening line 22 is a generally straight line that extends generally transverse to the dispensing passageway 24 and across container 10. However, it is envisioned that the passageway and/or the opening line may extend at an angle across and through the passageway, depending on the particular application and desired dispensing pattern.

Optionally, and as shown in FIGS. 1 and 2, fluid dispenser 10 may include an aperture 40 through the header portion 14 to facilitate hanging of the container or dispenser at a support rod or post or peg or hook, such as a peg-board type display or the like. Optionally, multiple fluid dispensers may be suspended from the same post or hook, such that a fluid dispenser at the end of the post will be displayed and easily removed from the post, such as for use or purchase.

Dividers 20*a*, 20*b*, 20*c* may comprise sealed portions or regions between the flexible sheets or sheet portions of container 12, or may comprise webs or walls extending between the sheet portions. A breakable or openable or frangible portion 32*a*, 32*b*, 32*c* is provided at each divider 20*a*, 20*b*, 20*c*, such as in a central region of the respective divider. The frangible portions initially prevent flowable material 26 from flowing between the chambers, and are openable to permit flowable material to flow through the dividers and out of container 12 through dispensing passageway 24.

Frangible portions 32*a*, 32*b*, 32*c* may comprise thin or weakened regions along respective dividers 20*a*, 20*b*, 20*c* such that a pressure rise in one of chambers 18*b*, 18*c*, 18*d* will cause a respective one of frangible portions 32*a*, 32*b*, 32*c* to burst or open (whereby the sealed sheet portions at the divider may separate to allow fluid flow from one chamber to the other) to allow fluid flow in a direction towards dispensing passageway 24. Optionally, for example, frangible portions 32*a*, 32*b*, 32*c* may comprise regions where the sheet members are sealed together to a lesser degree than the perimeter regions or non-frangible portions of the dividers so as to readily separate upon the application of sufficient pressure. The lesser-sealed or separably sealed frangible regions may be areas where the sealed area is smaller than in the perimeter regions or non-frangible portions, or where the seal or bond between the sheet portions is weaker than in other regions so that only the frangible region of a particular divider opens upon application of a sufficient amount of pressure. Optionally, the frangible portions may be located anywhere along the dividers, such as near opposite side regions 30.

For example, and with reference to FIG. 2, after flowable material 26 has been substantially dispensed or exhausted from chamber 18*a*, a user may squeeze or press chamber 18*b* to raise the fluid pressure within chamber 18*b* until frangible portion 32*a* bursts or opens to release fluid from chamber 18*b* into chamber 18*a* and out through dispensing passageway 24. In a similar manner, pressure may be applied to chamber 18*c* in order to burst or open frangible portion 32*b* to release fluid into chamber 18*b* via frangible portion 32*b*, and then urge the fluid into chamber 18*a* via open frangible portion 32*a*, and expel the fluid out through dispensing passageway 24. In a similar manner, fluid from chamber 18*d* may be expunged through frangible portions 32*c*, 32*b*, 32*a* in order to expel fluid from chamber 18*d* out of container 12 through dispensing passageway 24 and out of opening 24*a*.

The present invention thus provides a method or means for dispensing or applying flowable material onto a targeted object or surface in a fixed or precise quantity that is less than the entire contents of the container. For example, a user may grasp header portion 14 near notch 34 and remove header portion 14 from container 12, thus opening and exposing passageway opening 24*a* of dispensing passageway 24. Chamber 18*a* is then squeezed or compressed to force flowable material 26 out through passageway opening 24*a*. If additional flowable material is desired, the user compresses chamber 18*b* until frangible portion 32*a* bursts or opens, thus permitting the flowable material contained in chamber 18*b* to pass through divider 20*a* at frangible portion 32*a*, whereupon the user continues to squeeze chamber 18*b*, and then chamber 18*a* (or squeezes chambers 18*a* and 18*b* simultaneously), in order to expunge the contents of chamber 18*b* through dispensing passageway 24. The contents of chambers 18*c*, 18*d* may be expunged through dispensing passageway 24 in a similar manner, such as by squeezing chamber 18*c* to burst or open frangible portion 32*b*, and squeezing chamber 18*d* to burst or open frangible portion 32*c*.

Optionally, if the user wishes to use the contents of, for example, chambers 18*a* and 18*b*, without using the contents of chambers 18*c* and 18*d*, container 12 may be stored indefinitely in the condition illustrated in FIG. 2 such that frangible portions 32*b* and 32*c* remain sealed to prevent flowable material 26 from exiting chambers 18*c*, 18*d*. When the user does wish to access and use the contents of chambers 18*c* and/or 18*d*, the user may squeeze chamber 18*c* until frangible portion 32*b* bursts, and then urge flowable material 26 through chamber 18*b* and chamber 18*a*, and out through dispensing passageway 24 (or the user may dispense the later used contents by making another dispensing opening, such as in cases where the previously used material in chamber 18*a* may have cured and hardened). The use of fluid dispenser 10 is facilitated by squeezing a given chamber in the vicinity of the frangible portion furthest from dispensing passageway 24 in order to encourage only the frangible portion nearest dispensing passageway 24 to burst in order to move flowable material 26 only toward dispensing passageway 24, and not away from it. The pouch or container may indicate the quantity of flowable material in each chamber, so that the user may, in advance of opening the container and/or dispensing the flowable material, determine how many chambers need to be accessed and, thus, how many frangible dividers need to be broken, and may proceed accordingly.

Figure 3:
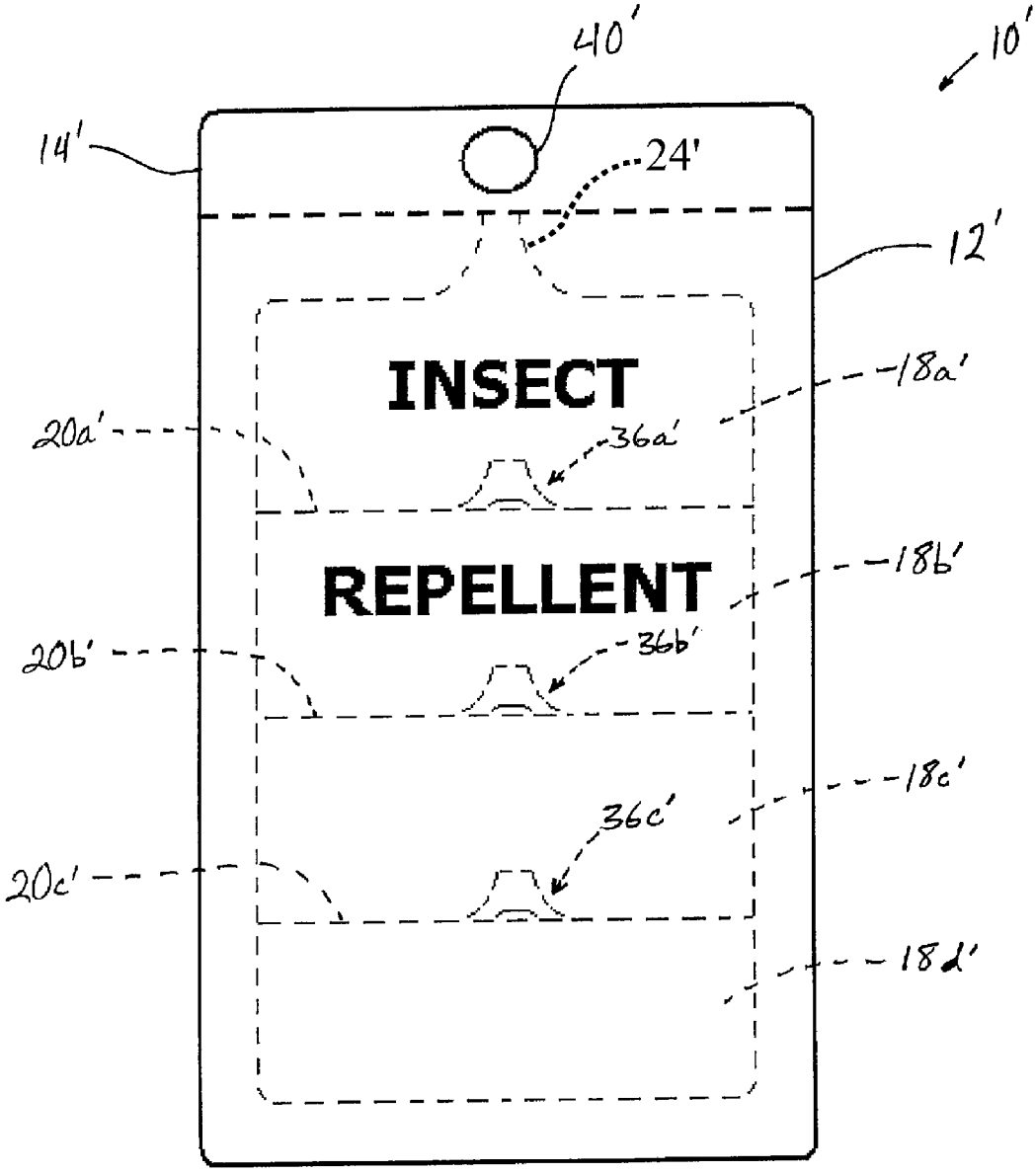
FIG. 3 is a plan view of a fluid dispenser according to another embodiment of the present invention, with valves positioned along dividers between internal chambers.

Optionally, and as shown in FIG. 3, a fluid dispenser 10' compromises a flexible pouch or container 12' that may include valves or valve elements 36*a*', 36*b*', 36*c*' at dividers 20*a*', 20*b*', 20*c*' for permitting one-way flow of fluid or flowable material across the dividers. Thus, valves 36*a*', 36*b*', 36*c*' comprise one-way valves or check valves that permit fluid flow from chamber 18*b*' to chamber 18*a*', from chamber 18*c*' to both chambers 18*b*' and 18*a*', and from chamber 18*d*' to each of chambers 18*c*', 18*b*', 18*a*', while limiting or substantially preventing flow of fluid or flowable material in an opposite direction. Fluid dispenser 10' thus functions in a substantially similar manner as fluid dispenser 10, except that valves 36*a*'-*c*' may permit flow in only one direction, toward dispensing passageway 24' at header portion 14' (which may have an aperture 40' therethrough for hanging the container, such as at a post or support arm or the like), such that the contents of chamber 18*a*' may not be forced through valve 36*a*' into chamber 18*b*', allowing the user to apply pressure while forcing its contents in only one direction.

Preferably, the flowable materials contained in each chamber are substantially identical, and may be non-drying and/or non-curing, so that the container may be stored with the header portion removed and the flowable material from the chamber 18*a* closest to the dispensing passageway either partially or fully depleted, without the flowable material drying or curing in a manner that blocks the opening at the dispensing passageway. Thus, the container may be stored indefinitely in an open state with fresh flowable material stored or available in at least one of other chambers remote from the dispensing passageway. Optionally, however, it is envisioned that the container may contain a hardenable material, whereby a dispensing opening at one or more of the chambers may be made by the user to allow for dispensing material from a lower or other chamber (such as, for example, chamber 18*c*) in situations where the material previously dispensed from the container has hardened and blocked the dispensing passageway 24.

Optionally, one of the dividers may comprise a non-frangible divider to separate one type of fluid in one or more chambers on one side of the non-frangible divider from another type of fluid in one or more chambers on the other side of the non-frangible divider (such as sunscreen compositions having different sun protection factors or insect repellents having a different amounts of active ingredients or the like). For example, a first type of fluid (such as, for example, sunscreen having a first sun protection factor (SPF) rating, such as SPF 30) may be stored in two or more chambers separated by one or more frangible dividers, while a second type or grade of substantially similar fluid (such as sunscreen having a different SPF rating than the first fluid, such as SPF 50) may be stored in other chambers separated by one or more frangible dividers, with a non-frangible or substantially non-frangible or non-openable divider separating the chambers containing the first type of fluid from the chambers containing the second type of fluid. For example, dividers 32*a* and 32*c* of container 10 may comprise frangible or separably sealed dividers while divider 32*b* may comprise a non-frangible or non-openable divider in such an application. The chambers on one side of the non-frangible divider thus may cooperate to dispense one type of material composition (while limiting or controlling the amount dispensed), while the chambers on the other side of the non-frangible divider may cooperate to dispense another type of material composition (while limiting or controlling the amount dispensed).

Figure 4:
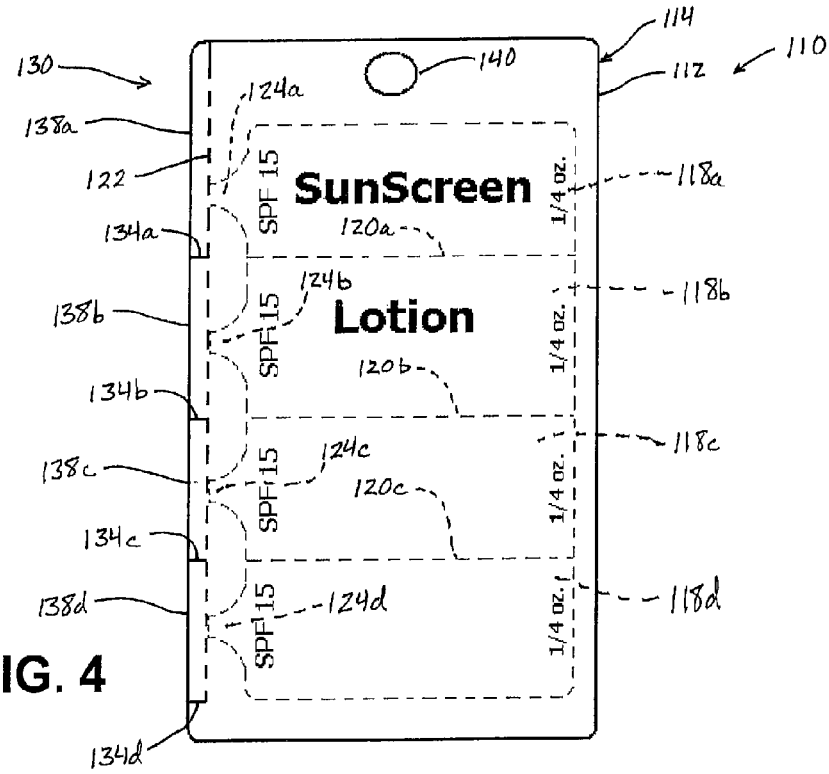
FIG. 4 is a plan view of another fluid dispenser in accordance with the present invention.
Figure 5:
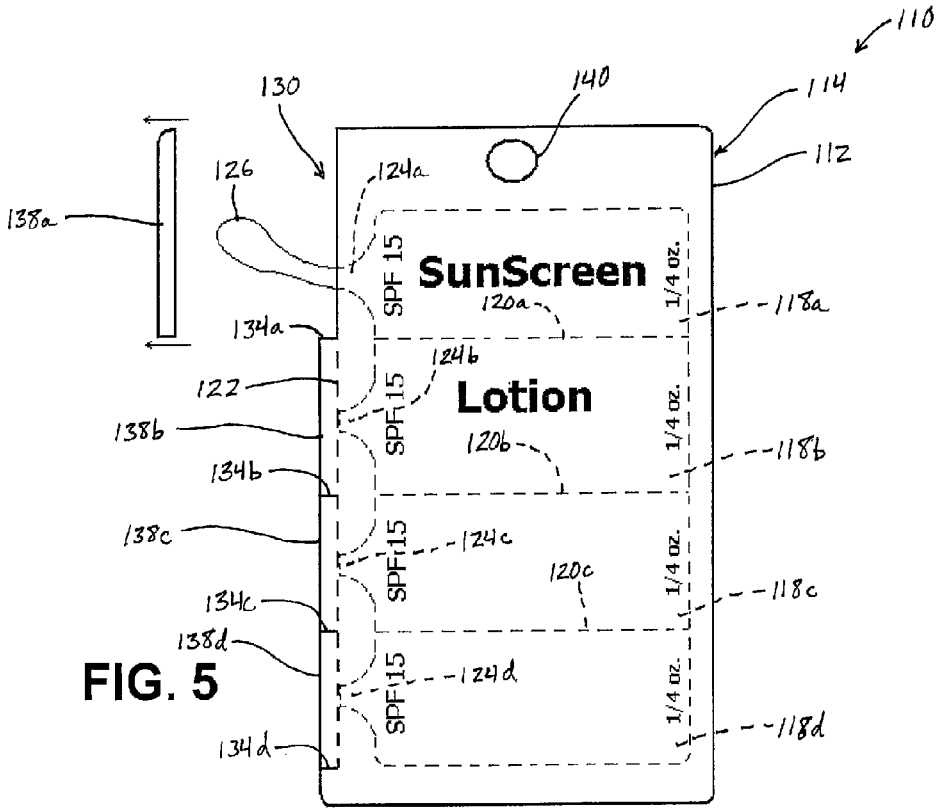
FIG. 5 is a plan view of the fluid dispenser of FIG. 4, shown with a section of the fluid dispenser torn away to dispense the contents from a portion of the dispenser.

Optionally, and with reference to FIGS. 4 and 5, a fluid dispenser 110 comprises a container 112 having a plurality of chambers 118*a*, 118*b*, 118*c*, 118*d* separated by frangible dividers 120*a*, 120*b*, 120*c*. Each chamber has a respective dispensing passageway 124*a*, 124*b*, 124*c*, 124*d* extending from the chamber toward a side region 130 of container 112. Optionally, the fluid dispenser 110 may include a header portion 114, and may have a hanging aperture 140, such as described above.

In the illustrated embodiment, the dispensing passageways are disposed or formed or established at the side regions of the dispenser, wherein the side region 130 comprises a plurality of removable edge portions 138*a*, 138*b*, 138*c*, 138*d* for sealing off the respective dispensing passageways 124*a*, 124*b*, 124*c*, 124*d* until such time as a user wishes to access the fluid contained in one or more of the chambers. An opening line 122 extends along side region 130 and across the passageways to permit opening individual passageways without opening the remaining passageways, if desired. Optionally, notches 134*a*, 134*b*, 134*c*, 134*d* (FIG. 4) may be cut or formed in or across side region 130 and spaced from respective passageways, in order to facilitate removal of single removable edge portions, without unintentionally removing other edge portions, thereby reducing the risk of unintentional opening of a chamber.

For example, any of the removable edge portions, such as edge portion 138*a*, may be removed to open a single dispensing passageway, such as dispensing passageway 124*a* (FIG. 5), in order to permit flowable material 126 to be squeezed or expunged from chamber 118*a*, while the remaining chambers 118*b*, 118*c*, 118*d* remain sealed and unused (or previously unsealed and unused). Thus, any of the chambers, or any combination of the chambers, may be opened and used without opening all of the contents of the container and exposing it to air. Fluid dispenser 110 thus may be suitable for use with substances that dry or cure, such as adhesives, sealants, and the like, such that after the contents of one chamber is used up, the remaining contents of the unused chambers remain uncured and free to flow through the respective passageways once the removable edge portions are subsequently removed. Fluid dispenser 110 may otherwise be substantially similar to fluid dispensers 10, 10', such that detailed discussion of the fluid dispenser need not be repeated herein. Optionally, the dividers 120*a-c* may include frangible portions or valves to allow for dispensing of material from two or more chambers through a common or primary dispensing passageway, such as in a similar manner as discussed above. In such an embodiment, the material may be initially expunged through the first or primary dispensing passageway, but material not initially used may be later expunged through a different dispensing passageway.

For example, a fluid dispenser may be formed with a dispensing passageway at a header, such as passageway 24 and header 14 of container 12 of FIGS. 1 and 2, along with individual dispensing passageways provided at other chambers, such as passageways 124*b-d* of chambers 118*b-d* of container 112 of FIGS. 4 and 5. Such an arrangement would permit the contents of one chamber, or any number of chambers (via opening of one or more frangible dividers), to be dispensed through the dispensing passageway at the header, and/or would permit the contents of any chamber to be dispensed through the respective dispensing passageway of that chamber. Optionally, the dispensing passageways and removable edge portions and/or the header or headers (which may include a hanging aperture, such as described above) may be positioned substantially anywhere around the perimeter of the fluid dispenser, without departing from the spirit and scope of the present invention.

Thus, the dispenser or container may provide a plurality of single-use packets that are individually openable and usable if only a small quantity of fluid or material is desired for a particular use or application, and may utilize aspects of the containers described in U.S. Pat. No. 7,241,066, which is hereby incorporated herein by reference in its entirety. However, if a larger quantity of material (such as larger than a quantity of flowable material contained in one of the single-use packets or chambers) is desired for a given use or application, the user may squeeze one of the chambers to break the frangible divider to allow the flowable material to flow into the adjacent chamber for dispensing from the dispensing passageway of the adjacent chamber, such as in a similar manner as described above. Thus, the container may allow for dispensing larger quantities of flowable material through a common or single dispensing passageway, while allowing for independent dispensing of the chambers, such as for applications where the flowable material in an opened chamber cures or hardens or otherwise precludes or inhibits further dispensing from the dispensing passageway of the first opened chamber.

Optionally, the header portion or removable edge portions of the container may include an applicator or spreader element at or along an edge thereof to assist in spreading the dispensed contents of the container at the targeted surface. For example, the header portion or removable edge portion may comprise or include a substantially rigid section and/or may include a rigid or substantially rigid perimeter region for a user to use to spread the dispensed fluid. The spreading element or applicator may, for example, comprise a roughened or serrated edge or a straight edge and/or may include graphics thereat (such as a graphical depiction of a brush or the like, such as by utilizing aspects of the containers described in U.S. Pat. No. 7,241,066, which is hereby incorporated herein by reference in its entirety) to indicate to the user how to use the header portion, either while it is yet attached to the dispenser or after it has been removed from the dispenser. The removable header portion or removable edge portion thus may allow for enhanced distribution of the dispensed fluid or flowable material while limiting or substantially avoiding human contact with the fluid or material.

Optionally, the pouch or container may include graphics and/or text (such as the graphics 38 of container or dispenser 10) printed or screened thereon to indicate the contents of the container. Additionally, the pouch may include graphics and text indicative of the locations of the chambers within the container, to instruct a user as to the operation of the container, or to advise a user of the quantity of flowable material contained in each chamber, for example. Such instructions or graphical instructions may include, for example, directions on where to tear the header portion or removable edge portions, and/or how to squeeze or compress the individual chambers in order to direct flowable material out of the chambers and/or through the frangible portions or valves along the dividers.

Accordingly, the present invention provides a container for storing multiple portions of flowable material that are stored in chambers separated by frangible dividers for keeping unused portions fresh and for preventing unused portions from leaking out of the container while the container is not actively being used. Thus, multiple portions of flowable material may be stored separately within the same container and dispensed from the container through a single opening or orifice as needed, without unintentionally permitting all of the flowable material to reach the dispensing portion of the container.

Therefore, the flexible pouch or container or dispenser of the present invention provides a low cost pouch-type container with versatility in dispensing a precise and/or preselected quantity of fluid from one or more of a plurality of chambers of the pouch container. The multiple chambers allow a user to select the desired or appropriate quantity of flowable material according to the number of chambers that are accessed during use, such as by urging or forcing fluid through a frangible wall or divider or valve. The flexible pouch is formed via selective sealing of the opposed flexible sheet portions to provide the desired chambers (the size, shape, and quantity of the chambers may be selected or determined according to the number and size of chambers and passageways and/or size and/or shape and/or length of the chambers and/or passageways and/or container) without additional components or caps or the like that may add to the cost of the flexible pouches. Such a low cost adaptation of flexible pouches is desired, since such sealed flexible pouches are typically intended for small packets, such as single-use packets or samples, which are often used for multiple tasks spread out over a long period of time, such that it is desirable to minimize the cost of the packaging, and to minimize the exposure and leakage of unused portions of flowable material contained by the packaging between individual uses of the package or container. The chambers may be readily formed in the desired size/shape/quantity, and the number and location of dividers and/or dispensing passageways may be selected according to the type of flowable material contained therein (e.g. whether a curing material or a non-curing material).

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A method of expunging a flowable material from a container, said method comprising:

providing a container for storing the flowable material, said container including first and second sheet portions sealed together along a perimeter of said container to define first and second chambers for containing the flowable material, the flowable material comprising substantially the same material composition in each of said first and second chambers, said sheet portions being sealed together at a dispensing portion to define a dispensing passageway at said first chamber, said first and second chambers being separated by at least one divider, said divider configured to at least initially limit flow of the flowable material between said first and second chambers;

providing a header portion along said perimeter at said dispensing portion of said container, wherein said dispensing passageway is disposed at said first chamber and at least partially in said header portion;

opening said dispensing passageway for dispensing the flowable material from said first chamber while said divider remains unopened, wherein opening said dispensing passageway comprises at least partially removing said header portion;

after said opening of said dispensing passageway, applying pressure to said first chamber to dispense the flowable material from said first chamber onto a surface while said divider remains unopened;

after said applying pressure to said first chamber, applying pressure to said second chamber to open said divider and to urge the flowable material from said second chamber through a portion of said divider and into said first chamber; and after said applying pressure to said second chamber, applying pressure to said first chamber to dispense the flowable material from said second chamber through said dispensing passageway and onto the surface.

2. The method of claim 1, further comprising:

providing a frangible region at said at least one divider, said frangible region configured to open to permit flow of the flowable material from said second chamber to said first chamber when sufficient pressure is applied to said second chamber.

3. The method of claim 1, further comprising:

providing a one-way valve at said at least one divider, said valve configured to permit flow of the flowable material from said second chamber to said first chamber when sufficient pressure is applied to said second chamber and to limit flow of the flowable material from said first chamber to said second chamber.

4. The method of claim 1, wherein said divider is established by sealing respective portions of said sheet portions and wherein said divider is opened by unsealing a portion of said sealed together sheet portions when pressure is applied to said second chamber.

5. The method of claim 1, wherein opening said dispensing passageway comprises at least partially tearing or cutting said header portion from said container along an opening line of said container, said opening line intersecting said dispensing passageway.

6. The method of claim 1, wherein said opening said dispensing passageway comprises at least partially tearing or cutting a removable portion from said container along an opening line of said container, said opening line intersecting said dispensing passageway.

7. The method of claim 1, further comprising:

providing third and fourth chambers defined by said first and second sheet portions for containing a second flowable material, the second flowable material comprising a different material composition than the flowable material in said first and second chambers, said sheet portions being sealed together at a second dispensing portion to define a second dispensing passageway at one of said third and fourth chambers, said third and fourth chambers being at least partially separated by a second divider, said second divider configured to at least initially limit flow of the second flowable material between said third and fourth chambers;

providing a non-frangible divider between said second and third chambers, said non-frangible divider configured to prevent flow of the flowable material between said second and third chambers;

opening said second dispensing passageway for dispensing the second flowable material from at least one of said third and fourth chambers;

applying pressure to said third chamber to dispense the second flowable material from said third chamber onto a surface;

applying pressure to said fourth chamber to open said second divider between said third and fourth chambers and to urge the second flowable material from said fourth chamber through a portion of said second divider and into said third chamber; and applying pressure to said third chamber to dispense the second flowable material from said fourth chamber through said dispensing passageway and onto the surface.

8. The method of claim 7, wherein said dividers comprise openable regions, said openable regions being portions of said first and second sheet portions that are separably sealed to one another.

9. The method of claim 8, wherein said separably sealed regions comprise relatively weakly sealed regions of said sheet portions.

10. The method of claim 7, wherein a portion of said container at each of said dispensing portions is at least partially removable from said container to open each of said dispensing portions for dispensing the flowable material from each of said chambers.

* * * * *